US007002079B2

(12) United States Patent
Mitchell et al.

(10) Patent No.: US 7,002,079 B2
(45) **Date of Patent: *Feb. 21, 2006**

(54) INDICATORS FOR EARLY DETECTION OF POTENTIAL FAILURES DUE TO WATER EXPOSURE OF POLYMER-CLAD FIBERGLASS

(75) Inventors: Joseph N. Mitchell, San Antonio, TX (US); Spring M. Haby, San Antonio, TX (US); Dennis S. Rushforth, San Antonio, TX (US); Mark E. Van Dyke, Winston Salem, NC (US); Henry W. Oviatt, Jr., Temecula, CA (US); Andrew J. Philips, Charlotte, NC (US); Ralph H. Hill, Jr., San Antonio, TX (US); Mary C. Marshall, San Antonio, TX (US)

(73) Assignee: Electric Power Research Institute, Palo Alto, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/099,187

(22) Filed: Apr. 4, 2005

(65) Prior Publication Data

US 2005/0269127 A1 Dec. 8, 2005

Related U.S. Application Data

(63) Continuation-in-part of application No. 10/641,511, filed on Aug. 14, 2003, now Pat. No. 6,930,254.

(51) Int. Cl.
*H01B 17/34* (2006.01)

(52) U.S. Cl. ..... 174/140 C; 174/137 A; 174/137 B; 174/137 R; 174/138 R; 174/179; 428/414

(58) Field of Classification Search ..... 174/137 A, 174/137 B, 137 R, 138 C, 138 F, 138 R, 174/140 C, 140 H, 141 C, 142, 178, 179, 174/211; 361/117, 124, 127; 428/414, 425, 428/450.8, 457

See application file for complete search history.

(56) References Cited

*Primary Examiner*—Dean A. Reichard
*Assistant Examiner*—Adolfo Nino
(74) *Attorney, Agent, or Firm*—Dergosits & Noah LLP

(57) ABSTRACT

A composite insulator containing means for providing early warning of impending failure due to stress corrosion cracking, flashunder, or destruction of the rod by discharge activity conditions is described. A composite insulator comprising a fiberglass rod surrounded by a polymer housing and connected with metal end fittings on either end of the rod is doped with a dye-based chemical dopant. The dopant is located around the vicinity of the outer surface of the fiberglass rod. The dopant is formulated to possess migration and diffusion characteristics, and to be inert in dry conditions and compatible with the insulator components. The dopant is positioned within the insulator such that upon the penetration of moisture through the housing to the rod through a permeation pathway in the outer surface of the insulator, the dopant will become activated and will leach out of the same permeation pathway or diffuse through the housing. The activated dopant then creates a deposit or stain on the outer surface of the insulator housing. The dopant comprises an oil-soluble dye, an indicator, or a stain compound that can either be visually identified, or is sensitive to radiation at one or more specific wavelengths. The dopant could also be formulated by a nanoparticle enabled material. Deposits of activated dopant on the outer surface of the insulator can be detected upon imaging of the outer surface of the insulator by appropriate imaging instruments or the naked eye.

21 Claims, 11 Drawing Sheets

INDICATORS FOR EARLY DETECTION OF POTENTIAL FAILURES DUE TO WATER EXPOSURE OF POLYMER-CLAD FIBERGLASS

CROSS-REFERENCE TO RELATED APPLICATIONS

The present application is a Continuation-in-Part application of currently patent application Ser. No. 10/641,511, filed on Aug. 14, 2003 now U.S. Pat. No. 6,930,254 and entitled Chemically-Doped Composite Insulator for Early Detection of Potential Failures Due to Exposure of the Fiberglass Rod, which is assigned to the assignees of the present application.

FIELD OF THE INVENTION

The present invention relates generally to insulators for power transmission lines, and more specifically to chemically-doped transmission and distribution components, such as composite (non-ceramic) insulators or polymer-clad fiberglass vessels that provide improved identification of units with a high risk of failure due to environmental exposure of the fiberglass core.

BACKGROUND OF THE INVENTION

Power transmission and distribution systems include various insulating components that must maintain structural integrity to perform correctly in often extreme environmental and operational conditions. For example, overhead power transmission lines require insulators to isolate the electricity-conducting cables from the steel towers that support them. Traditional insulators are made of ceramics, such as glass, but because ceramic insulators are typically heavy and brittle, a number of new insulating materials have been developed. As an alternative to ceramics, composite polymer materials were developed for use in insulators for transmission systems around the mid-1970's. Such composite insulators are also referred to as "non-ceramic insulators" (NCI) or polymer insulators, and usually employ insulator housings made of materials such as ethylene propylene rubber (EPR), polytetrafluoro ethylene (PTFE), silicone rubber, or other similar materials. The insulator housing is usually wrapped around a core or rod of fiberglass (alternatively, fiber-reinforced plastic or glass-reinforced plastic) that bears the mechanical load. The fiberglass rod is usually manufactured from glass fibers surrounded by a resin. The glass-fibers may be made of E-glass, or similar materials, and the resin may be epoxy, vinyl-ester, polyester, or similar materials. The rod is usually connected to metal end-fittings or flanges that transmit tension to the cable and the transmission line towers.

Although composite insulators exhibit certain advantages over traditional ceramic and glass insulators, such as lighter weight and lower material and installation costs, composite insulators are vulnerable to certain failures modes due to stresses related to environmental or operating conditions. For example, insulators can suffer mechanical failure of the rod due to overheating or mishandling, or flashover due to contamination. A significant cause of failure of composite insulators is due to moisture penetrating the polymer insulator housing and coming into contact with the fiberglass rod. In general, there are three main failure modes associated with moisture ingress in a composite insulator. These are:

stress corrosion cracking (brittle-fracture), flashunder, and destruction of the rod by discharge activity.

Stress corrosion cracking, also known as brittle fracture, is one of the most common failure modes associated with composite insulators. The term "brittle fracture" is generally used to describe the visual appearance of a failure produced by electrolytic corrosion combined with a tensile load. The failure mechanisms associated with brittle fracture are generally attributable to either acid or water leaching of the metallic ions in the glass fibers resulting in stress corrosion cracking. Brittle fracture theories require the permeation of water through pathways in the polymer housing and an accumulation of water within the rod. The water can be aided by acids to corrode the glass fiber within the rod. Such acids can either be resident within the glass fiber from hydrolysis of the epoxy hardener or from corona-created nitric acid. FIG. 1 illustrates an example of a failure pattern within the rod of a composite insulator due to brittle fracture. The housing 102 surrounds a fiberglass rod 104. The fracture 108 is caused by stress corrosion due to prolonged contact of the rod with moisture, which causes the cutting of the fibers 106 within the rod.

Flashunder is an electrical failure mode, which typically occurs when moisture comes into contact with the fiberglass rod and tracks up the rod, or the interface between the rod and the insulator housing. When the moisture, and any by-products of discharge activity due to the moisture, extend a critical distance along the insulator, the insulator can no longer withstand the applied voltage and a flashunder condition occurs. This is often seen as splitting or puncturing of the insulator rod. When this happens, the insulator can no longer electrically isolate the electrical conductors from the transmission line structure.

Destruction of the rod by discharge activity is a mechanical failure mode. In this failure mode, moisture and other contaminants penetrate the weather-shed system and come into contact with the rod, resulting in internal discharge activity. These internal discharges can destroy the fibers and resin matrix of the rod until the unit is unable to hold the applied load, at which point the rod usually separates. This destruction occurs due to the thermal, chemical, and kinetic forces associated with the discharge activity.

Because the three main failure modes can mean a loss of mechanical or electrical integrity, such failures can be quite serious when they occur in transmission line insulators. The strength and integrity of composite insulators depends largely on the intrinsic electrical and mechanical strength of the rod, the design and material of the end fittings and seals, the design and material of the rubber weather shed system, the attachment method of the rod, and other factors, including environmental and field deployment conditions. As stated above, many composite insulator failures have been linked to water ingress into the fiberglass material comprising the insulator rod.

Since all three failure modes—brittle fractures, flashunder, and destruction of the rod by discharge activity, occur in the insulator rod, they are hidden by the housing and cannot easily be seen or perceived through casual inspection. For example, simple visual inspection of an insulator to detect failure due to moisture ingress requires close-up viewing that can be very time consuming, costly, and generally does not yield a definitive "go" or "no-go" rating. Additionally, in some cases, detection of rod failure through visual inspection techniques may simply be impossible. Other inspection techniques, such as daytime corona and infrared techniques can be used to identify conditions associated with discharge activity, which may be caused by one of the failure modes.

Such tests can be performed some distance from the insulator, but are limited in that only a small number of failure modes can be detected. Furthermore, the discharge activity must be present at the time of inspection to be detected, and a relatively high level of operator expertise and analysis is required.

To facilitate the detection of failure modes associated with exposure of rod cores to moisture, the use of dyes or similar markers that migrate to the surface of the housing through permeation paths before catastrophic damage occurs has been demonstrated. This generally provides an effective means of providing an early warning of impending failure due to stress corrosion, flashunder, or destruction of the rod by discharge activity, and allows inspection from a distance and without the need for the actual manifestation of failure symptoms. The composition of the dye or marker that is used for this type of inspection mechanism, however, is very important due to the environmental conditions that the dye is subjected to, as well as the practical limitations relating to inspection techniques for detecting the presence of the dye.

Some systems use highly visible, water-soluble dyes, such as methylene blue. This type of dye has been shown to effectively migrate through the fracture site in the polymer sheath of typical non-ceramic insulators, thus providing an effective indicator of moisture penetration through the insulator housing. However, some water-soluble dyes are photosensitive and can fade over time when subjected to outdoor conditions. Furthermore, many non-ceramic insulator housings are manufactured using silicone rubber. In general, silicone rubber is difficult to stain. Most colorants that are used with silicone rubber are pigments that are blended into the silicone before polymerization. Therefore, markers that are intended to stain silicone rubber housings in the field must be specially formulated.

It is desirable, therefore, to provide a semi-permanent dye for use in self-diagnosing systems for non-ceramic insulators that use silicone and other polymer housings to warn of potential failures of the insulator core due to moisture penetration through the housing.

SUMMARY OF THE INVENTION

A composite insulator or other polymer vessel, containing means for providing early warning of impending failure due to environmental exposure of the rod is described. A composite insulator comprising a fiberglass rod surrounded by a polymer housing and fitted with metal end fittings on either end of the rod is doped with a dye-based chemical dopant. The dopant is dispersed around the vicinity of the outer surface of the fiberglass rod, such as in a coating between the rod and the housing. It can also be dispersed throughout the rod matrix, such as in the resin component of the fiberglass rod. The dopant is formulated to possess migration and diffusion characteristics, and to be inert in dry conditions and compatible with the insulator components. The dopant is placed within the insulator such that upon the penetration of moisture through the housing to the rod through a permeation pathway in the outer surface of the insulator, the dopant will become activated and will leach out of the same permeation pathway or diffuse through the polymer housing to the sheath surface. The activated dopant then creates a deposit on the outer surface of the insulator housing. The dopant is formulated to bond to silicone rubber or other polymer housing surfaces and to be resistant to photo-oxidation with air and sunlight. The dopant comprises an oil-soluble dye or stain or indicator that can either be visually identified, or is sensitive to radiation at one or more specific wavelengths. Deposits of activated dopant on the outer surface of the insulator can be detected upon imaging or visualization of the outer surface of the insulator by appropriate imaging instruments or by the naked eye, respectively. The dopant comprises an organic dye that is synthesized with functional groups that allows the dye to covalently bond with silicone rubber, or a stain, micelle, or indicator that is miscible in silicone oil, a non-aqueous solvent, or silicone rubber. Alternatively, the dopant could comprise non-organic dyes that demonstrate a longer lasting fluorescent quantum yield, such as those that utilize Quantum Dots as the dopant within a delivery mechanism.

Other objects, configurations, features, and advantages of the present invention will be apparent from the accompanying drawings and from the detailed description that follows below.

BRIEF DESCRIPTION OF THE DRAWINGS

The present invention is illustrated by way of example and not limitation in the figures of the accompanying drawings, in which like references indicate similar elements, and in which.

DETAILED DESCRIPTION OF THE PREFERRED EMBODIMENT

A composite insulator or vessel containing an oil soluble chemical dopant for providing early warning of impending failure due to exposure of the fiberglass rod or glass-reinforced resin material to the environment is described. In the following description, for purposes of explanation, numerous specific details are set forth in order to provide a thorough understanding of the present invention. It will be evident, however, to one of ordinary skill in the art, that the present invention may be practiced using variants of these specific details. In other instances, well-known structures and devices are shown in block diagram form to facilitate explanation. The description of preferred embodiments is not intended to limit the scope of the claims appended hereto.

Lightweight composite insulators were developed in the late 1950s to replace ceramic insulators for use in high capacity (100's of kilovolt) power transmission lines. Such insulators featured great weight reduction, reduced breakage, lower installation costs, and various other advantages over traditional ceramic insulators. A composite insulator typically comprises a fiberglass rod fitted with two metal end-fittings, a polymer or rubber sheath or housing surrounds the rod. Typically the sheath has molded sheds that disperse water from the surface of the insulator and can be made of silicone or ethylene propylene diene monomer (EPDM) based rubber, or other similar materials.

Figure 1:
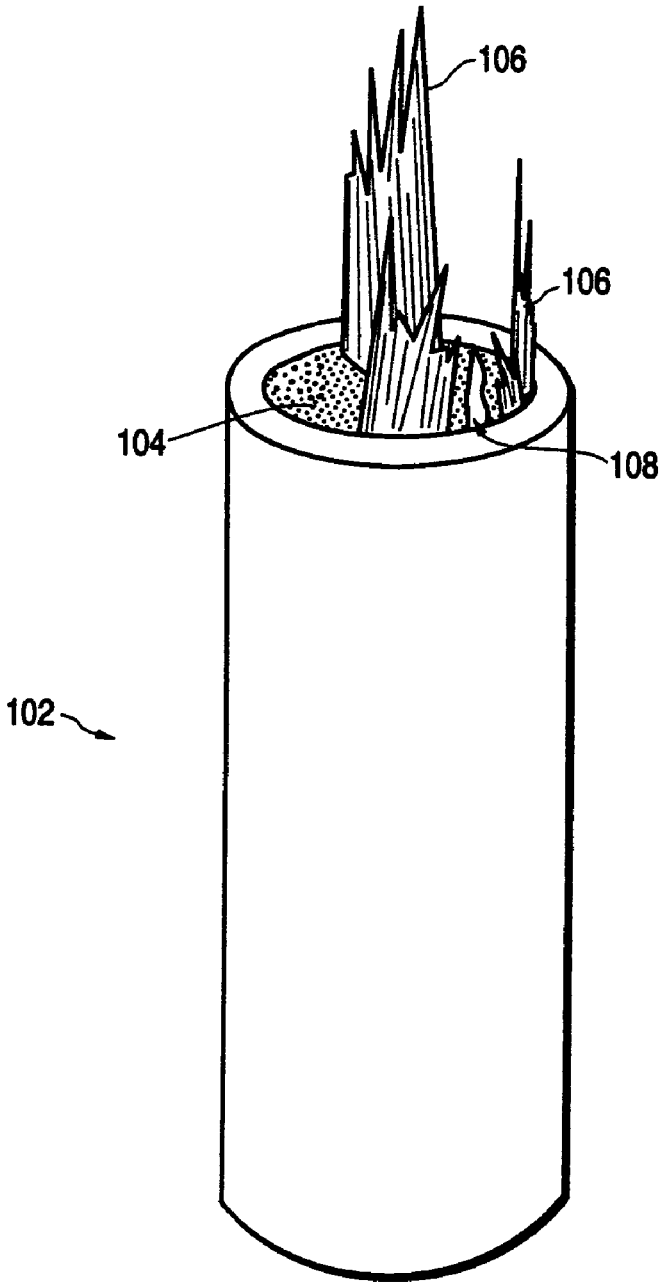
FIG.1 (PRIOR ART)
FIG. 1 illustrates an example of a failure pattern within the rod of a composite insulator due to brittle fracture.
Figure 2A:
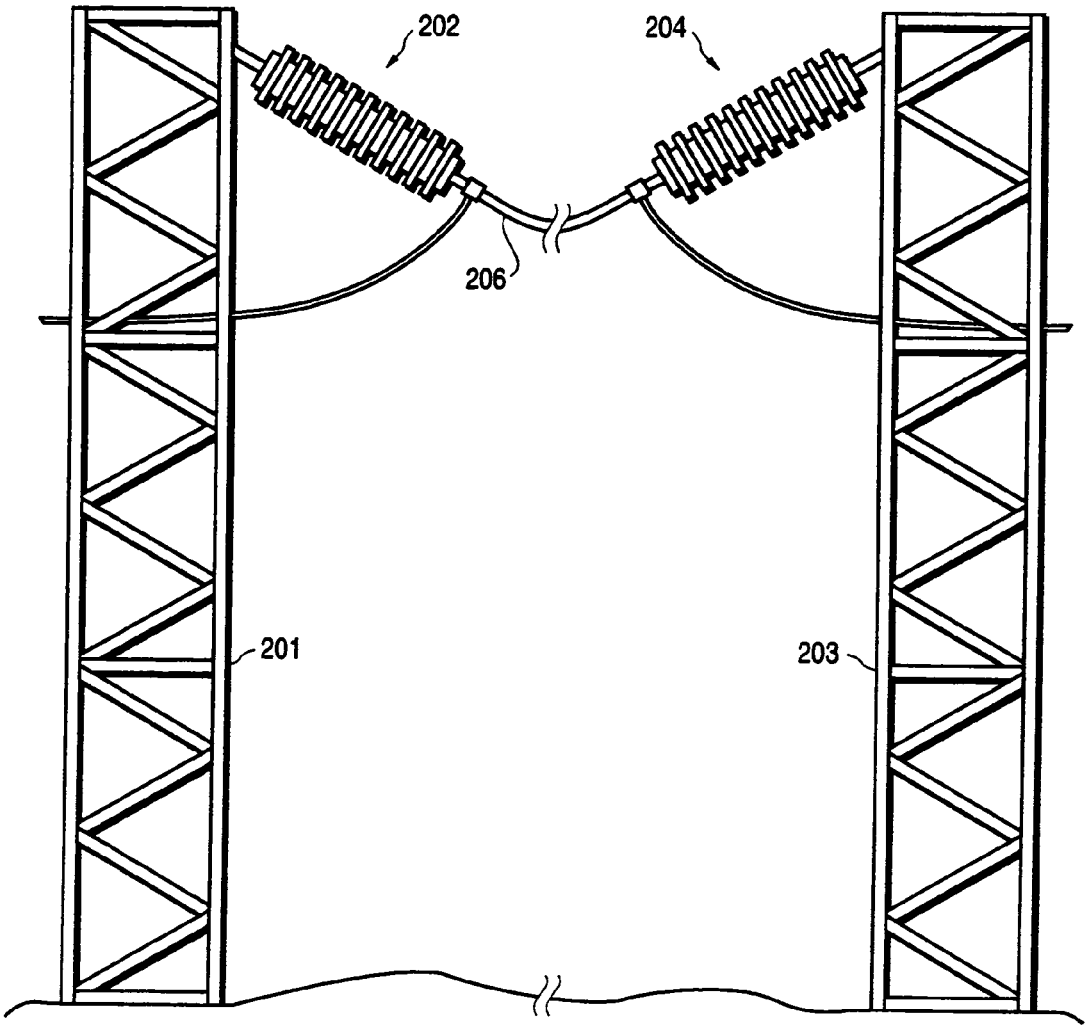
FIG. 2A illustrates a suspension-type composite insulator that can include one or more embodiments of the present invention.

FIG. 2A illustrates a suspension-type composite insulator that can include one or more embodiments of the present invention. Suspension insulators are typically configured to carry tension loads in I-string, V-string, or dead-end applications. In FIG. 2A, power line 206 is suspended between steel towers 201 and 203. Composite insulators 202 and 204 provide support for the conductor 206 as it stretches between the two towers. The integrity of the fiberglass rod within the insulators 202 and 204 are critical, and any failure could lead to an electrical short between conductor 206 and either of the towers 201 and 203, or allow the conductor 206 to drop to the ground.

Embodiments of the present invention may also be implemented in other types of transmission and distribution line and substation insulators. Moreover, other types of transmission and distribution components may also be used to implement embodiments of the present invention. These include bushings, terminations, surge arrestors, and any other type of composite article that provides an insulative function and is comprised of an outer surface with a composite or fiberglass inner component that is meant to be protected from the environment. The invention also applies to other industries where glass fiber reinforced resin is used for structural applications that have water-penetration failures, for example composite fuel storage tanks or vessels.

Figure 2B:
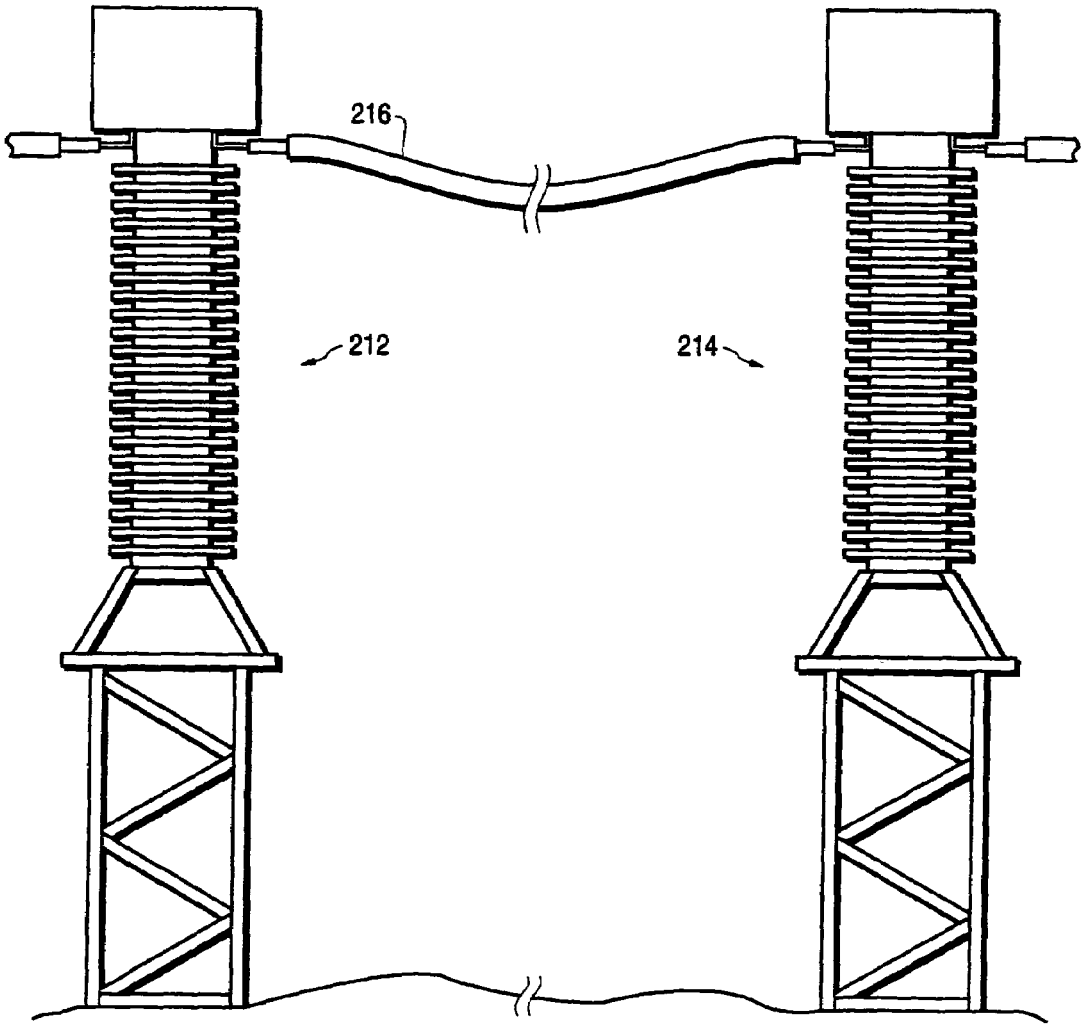
FIG. 2B illustrates a post-type composite insulator that can include one or more embodiments of the present invention.

FIG. 2B illustrates a post-type composite insulator that can include one or more embodiments of the present invention. Post insulators typically carry tension, bending, or compression loads. In FIG. 2B, conductor 216 stretches between towers that are topped by post insulators 212 and 214. These insulators also include a fiberglass core that is surrounded by a polymer or rubber housing and metal end fittings. Besides suspension and post insulators, aspects of the present invention can also be applied to any other type of insulator that contains a hermetically sealed core within a polymer or rubber housing, such as phase-to-phase insulators, and all transmission and distribution line and substation line insulators, as well as cable termination and equipment bushings.

The composite insulator 202 illustrated in FIG. 2A typically consists of a fiberglass rod encased in a rubber or polymer housing, with metal end fittings attached to the ends of the rod. Rubber seals are used to make a sealed interface between the end fittings and the insulator housing and to hermetically seal the rod from the environment. The seal can take a number of forms depending on the insulator design. Some designs encompass O-rings or compression seals, while other designs bond the rubber housing directly onto the metallic end fitting. Because power line insulators are deployed outside, they are subject to environmental conditions, such as exposure to rain and pollutants. These conditions can weaken and compromise the integrity of the insulator leading to mechanical failures and the potential for line drops or electrical short circuits.

If moisture is allowed to come into contact with the fiberglass rod within the insulator, various failure modes may be triggered. One of the more common types of failures is a brittle fracture type of failure in which the glass fibers of the rod fracture due to stress corrosion cracking. Other types of failures that can be caused by moisture ingress into the fiberglass rod are flashunder, and destruction of the rod by discharge activity. A significant percentage, if not a majority of insulator failures are caused by moisture penetration rather than by mechanical failure or electrical overload conditions. Therefore, early detection of moisture ingress to the rod is very valuable in ensuring that corrective measures are taken prior to failure in the field.

Although insulators are designed and manufactured to be hermetically sealed, moisture can penetrate the housing of an insulator and come into contact with the fiberglass rod in a number of different ways. For example, moisture can enter through cracks, pores, or voids in the insulator housing itself, through defects in an end fitting, or through gaps that may be formed by imperfect seals between the housing and end fittings. Such conditions may arise due to manufacturing defects or degradation due to time or mishandling by linecrews, and/or severe environmental conditions.

Current inspection techniques typically attempt to detect the presence of moisture and the onset of a failure due to cracks in the rod caused by brittle fracture, electrical discharges that may be destroying the rod, or changes in electrical field due to carbonization. These techniques, however, generally require that moisture be present at the time of inspection, or that the damage due to discharge be readily visible for the given inspection technique, e.g., visual inspection, x-ray, and so on.

Dopant Configuration

In one embodiment of the present invention, a chemical dopant is placed in or on the surface of the insulator rod or within the resin fiber matrix. When moisture penetrates the insulator housing and comes into contact with the rod, the dopant is activated. In this context, the term "activated" can include hydrolization, solubilization with or without a surfactant, dissolution of a protective coating, or chemical release of the dopant due to the presence of water, which allows the dopant to migrate to the surface of the insulator. In one configuration, the activated dopant is formulated so that upon activation, it can migrate through the permeation pathway in the housing, e.g., crack or gap, which allowed the moisture to penetrate to the rod. In another configuration, the water-activated dopant can diffuse through the polymer housing to the surface of the insulator. Once on the outside surface of the insulator housing, the presence of the dopant can be perceived through detection means that are sensitive to the type of dopant that is used. For example, a fluorescent-dye dopant can be perceived visually using an ultraviolet (UV) lamp. The detection of dopant on the outside of the insulator indicates the prior presence of moisture in contact with the core of the rod, even though moisture may not be present on or in the insulator, or the crack or gap may not be readily visible at the time of inspection.

Aspects of the invention utilize the fact that in the failure of a composite insulator, water migrates through the rubber housing and attacks the glass fibers by chemical corrosion. The water is essentially inert to the housing and the resin surrounding the glass fibers. The water typically reaches the fibers by permeation through cracks in the housing and/or rod resin as well as seal failures between the housing and end-fittings. If a water-soluble dye is in the pathway of the water, the dye will dissolve in the water. Since the pathways or cracks likely contain residual molecules of water, the dye will migrate back to the exterior surface of the insulator housing. This dye migration is driven by a concentration gradient. Since chemical equilibrium is the lowest energy state, the dye will attempt to become a uniform concentration wherever water is present, and will thus move away from the interior high concentration of dye to the exterior zero or lower concentration of dye. In addition, many dyes have high osmotic pressures when solubilized in water, so migration to the exterior of the housing may be aided by osmosis.

Figure 3:
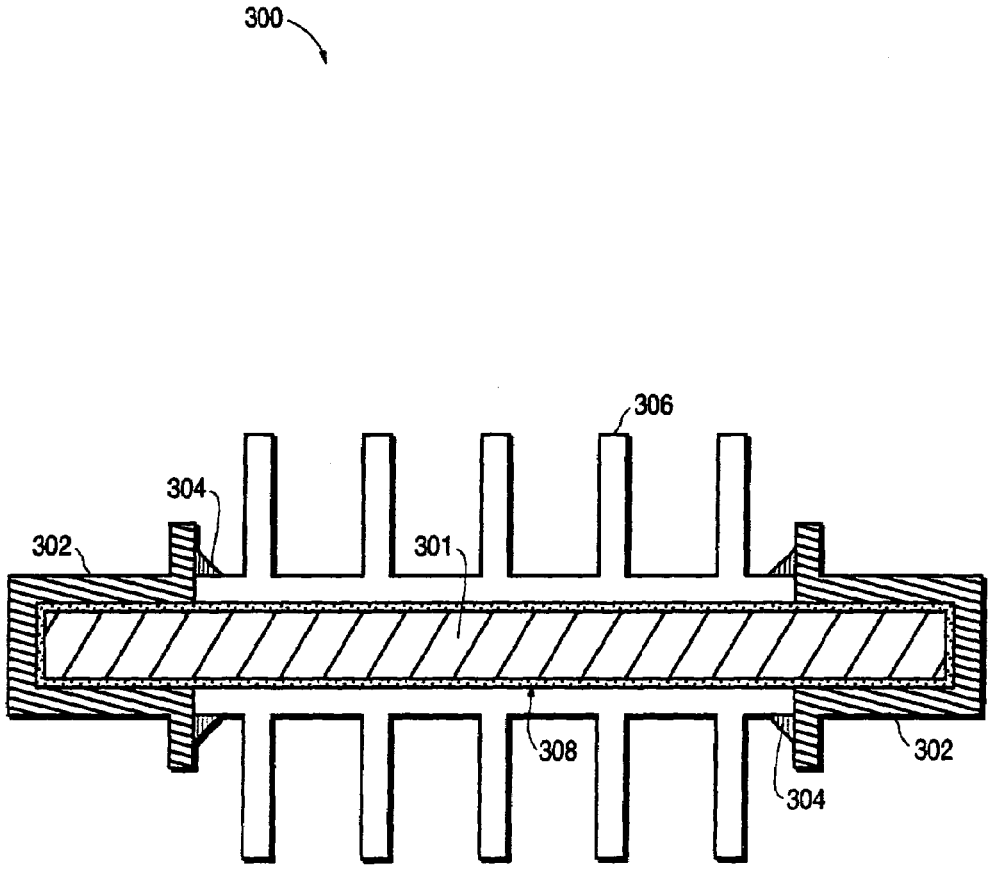
FIG. 3 illustrates the structure of a chemically doped composite insulator for indicating moisture penetration of the insulator housing, according to one embodiment of the present invention.

FIG. 3 illustrates the structure of a chemically doped composite insulator for providing indication of moisture penetration of the insulator housing, according to one embodiment of the present invention. The composite insulator 300 comprises a fiberglass rod 301 that is surrounded by a rubber or polymer housing 306. Attached to the ends of rod 301 are end fittings 302, which are sealed against the insulator housing 306 with rubber sealing rings 304. For the embodiment illustrated in FIG. 3, a chemical dopant 308 is applied along at least a portion of the surface of the fiberglass rod 301. The dopant can be applied to the outside surface of the rod 301, or the inside surface of the insulator 306, or both prior to insertion of the rod in the insulator housing, or wrapping of the insulator housing around the rod. Alternatively, the dopant can be injected between the insulator housing and rod before the end fittings are attached to one or both ends of the rod. The dopant/dye layer 308 could be a discrete dye layer, a coating/adhesive layer containing dye, or a surface layer of either rubber or epoxy that is impregnated with dye. An adhesive intermediate layer can provide a stronger bond between the rubber housing and composite rod that reduces the likelihood of moisture egress. This layer can also incorporate a nanoclay, which might help reduce moisture penetration by increasing the diffusion pathlength.

Figure 4:
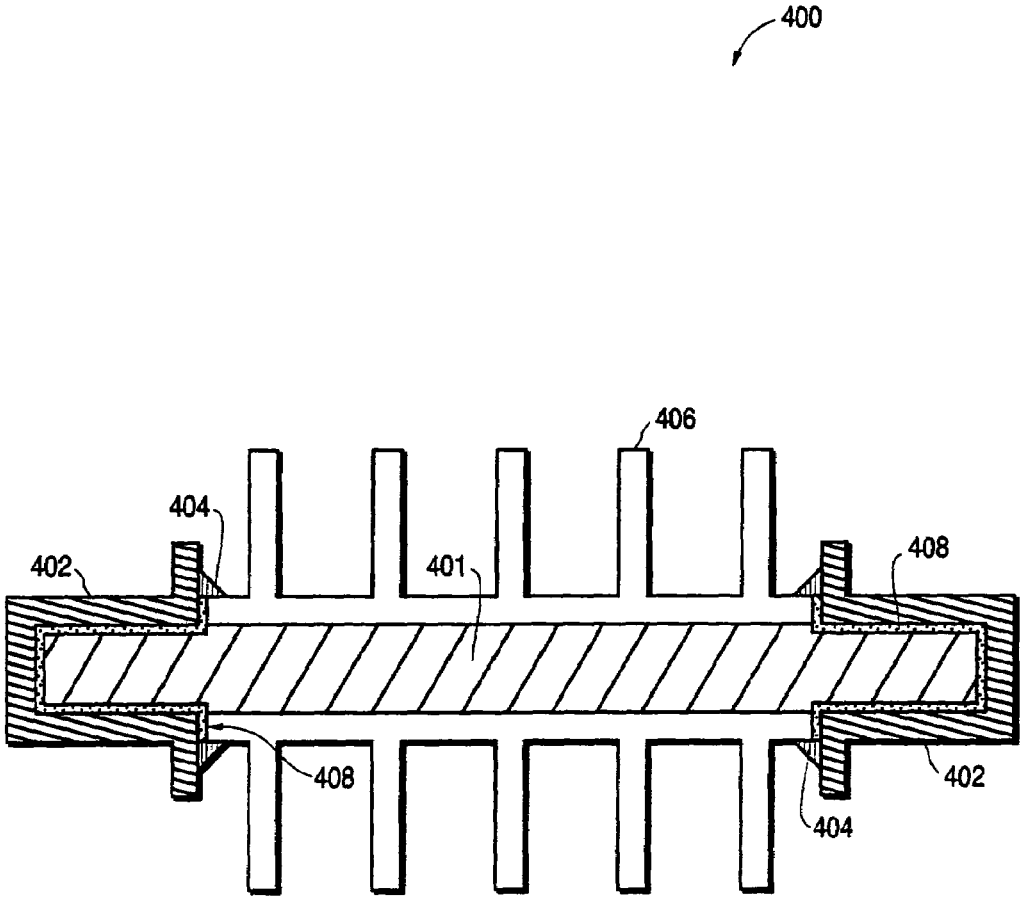
FIG. 4 illustrates the structure of a chemically doped composite insulator for indicating moisture penetration of the insulator housing, according to a first alternative embodiment of the present invention.

The dopant 308 can be dispersed around the surface of the rod or within the structure of the fiberglass rod in various other configurations than that shown in FIG. 3. FIG. 4 illustrates the structure of a chemically doped composite insulator for providing indication of moisture penetration of the insulator housing, according to an alternative embodiment of the present invention. The composite insulator 400 comprises a fiberglass rod 401 that is surrounded by a rubber or polymer housing 406. Attached to the ends of rod 401 are end fittings 402, which are sealed against the insulator housing 406 with rubber sealing rings 404. For the embodiment illustrated in FIG. 4, a chemical dopant 408 is applied along the underside of the end fittings 402 and along at least a portion of the underside surface of the seals 404. The embodiment illustrated FIG. 4 can be extended to include dopant along the entire surface of the rod 401, as illustrated in FIG. 3. The placement of dopant as illustrated in FIG. 4 facilitates the activation and migration of dopant in the event of a failure of the seal 404, or in the event of an imperfect seal between end fitting 402 and insulator housing 406.

The embodiments illustrated in FIGS. 3 and 4 show insulators in which the dopant is applied proximate to the surface of the fiberglass rod 301 or 401. In an alternative embodiment, the dopant may be distributed throughout the interior of the fiberglass rod. In this embodiment, a doping step can be incorporated in the manufacturing of the fiberglass rod. A fiberglass rod generally comprises glass fibers (e.g., E-glass) held together by a resin to create a glass-resin matrix. For this embodiment, the dopant may be added to a resin compound prior to the fiberglass rod being manufactured. The dopant can be evenly distributed throughout the entire cross-section of the rod. In this case, the amount of dopant that is released will increase as the rod becomes increasingly exposed and damaged. This allows the amount of activated dopant observed during an inspection to provide an indication of the level of damage within the rod, thereby increasing the probability of identifying a defective insulator.

In a further alternative embodiment of the present invention, the dopant can be distributed through the rubber or polymer material that comprises the insulator housing. For this embodiment, the dopant would preferably be placed in a deep layer of the insulator housing, close to the rod, so that it would be activated when moisture permeated the insulator close to the rod, rather than closer to the surface of the housing. Likewise, the dopant can be distributed through an upper layer of the fiberglass rod itself, rather than along the surface of the rod, as shown in FIG. 3. For this further embodiment, the dopant would be activated when moisture penetrated the insulator housing as well as the layer of the rod in which the dopant is present. The dopant can comprise a liquid, powdered, microencapsulated, or similar type of compound, depending upon specific manufacturing constraints and requirements.

The dopant can be configured to be a liquid or semi-liquid (gel) composition that allows for coating on a surface of the rod, insulator housing, or end fitting or for flowing within the insulator; or for mixing with the fiberglass matrix for the embodiment in which the dopant is distributed throughout the rod. Alternatively, the dopant can be configured to be a powder substance (dry) or similar composition for placement within the insulator or rod. Depending upon the composition of the rod, and manufacturing techniques associated with the insulator, the dopant can also be made as a granular compound.

The mechanism for applying the dopant to the composite insulator, such as during the manufacturing process, could include electrostatic attraction or van der Waals forces that adhere the solid particles to the surface of the rod, end-fittings, and/or the interior surface of the housing. The dopant could also be covalently bonded to the resin or rubber surface, with the bond being weakened or broken by contact with moisture.

Alternatively, the dopant can be incorporated in an adhesive layer, an extra coating of epoxy, or similar substance, on the rod, or intermingled in the rubber layer in contact with the fiberglass rod during vulcanization or curing process of the rubber housing.

Figure 5:
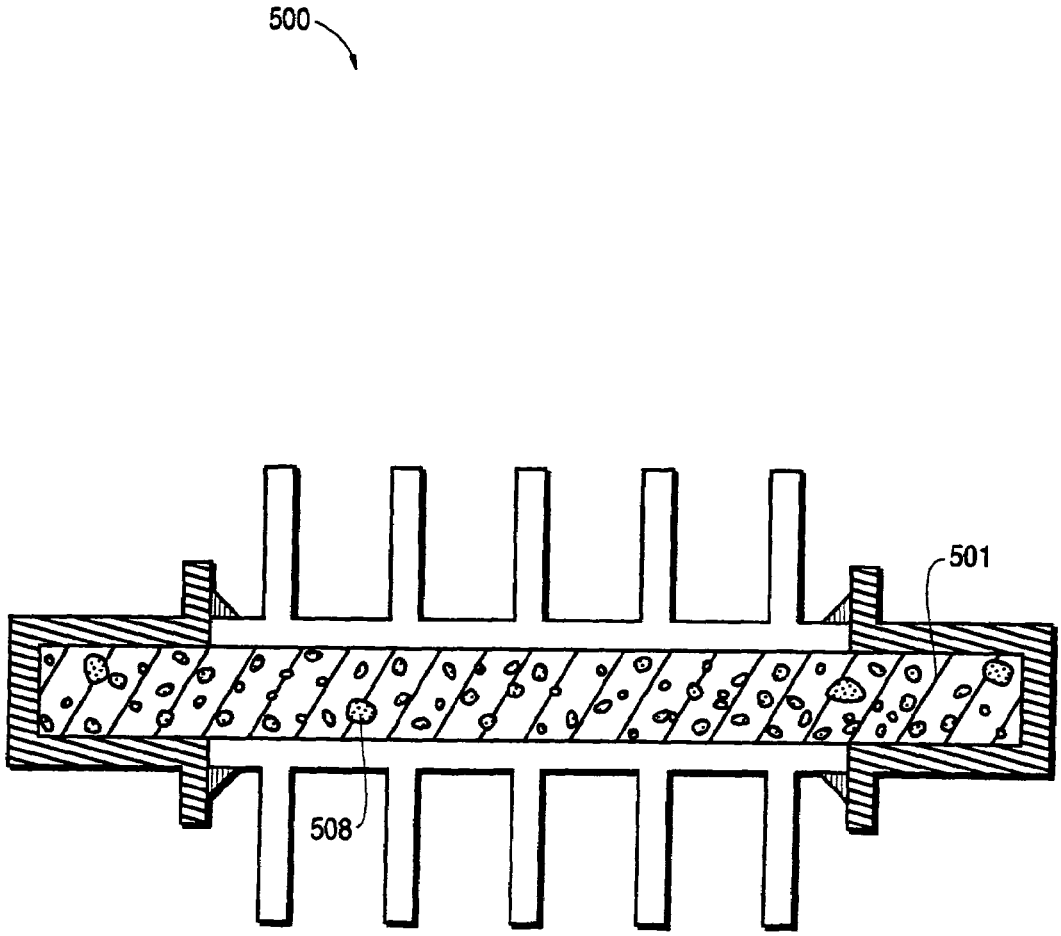
FIG. 5 illustrates the structure of a chemically doped composite insulator for indicating moisture penetration of the insulator housing, according to a second embodiment of the present invention.

FIG. 5 illustrates the structure of a chemically doped composite insulator for providing indicating moisture penetration of the insulator housing, according to a further alternative embodiment of the present invention. The composite insulator 500 comprises a fiberglass rod 501 surrounded by a rubber or polymer housing, with end fittings attached. For the embodiment illustrated in FIG. 5, a chemical dopant 508 is distributed throughout the rod in the form of a microencapsulated dye or salt-form of the dye. In such a salt-form, the dopant is activated by the acid or water present within the compromised insulator rod 501. As a salt or microencapsulated dye, the dopant is not likely to migrate within the insulator. In its ionic form upon exposure to acid or water, the dopant can migrate much more freely through the rod and out of any permeation pathway in the insulator housing. Such microencapsulated dye can also be used to package the dopant when used on the surface of the rod, or the interior of the housing, such as for the embodiments illustrated in FIGS. 3 and 4.

For the microencapsulated embodiment, the dye could be coated with a water-soluble polymer that protects the dye from contaminating the manufacturing plant and minimizes the potential for surface contamination of the dye on the exterior of the insulator housing during manufacturing. Such a polymer coating could also help prevent hydrolization or activation of the dye through exposure to ambient moisture during manufacturing.

With regard to microencapsulation, an alternative embodiment would be to encapsulate the dye in a capsule that is itself capable of migrating out of the permeation pathway. In this case, the dye solution is contained in a clear (transparent to the observing medium) microcapsule coating. Upon moisture ingress, the dye containing capsule would migrate to the surface of the housing and be trapped by the surface texture of the housing. The dye would then be detectable at the appropriate wavelengths through the coating. For this embodiment, the dye solution can be entrapped in a cyclodextrin molecule. In general, cyclodextrin is mildly water soluble (e.g., 1.8 gm/100 ml), so exposure to heavy moisture may cause the coating to dissolve. An alternative form of encapsulation is the use of a buckyball molecule. For this embodiment, a fullerene (buckyball) can contain another small molecule inside of it, thus acting as a nanocapsule. The nanocapsule sizes should be chosen such that migration through the permeation pathways is possible.

It should be noted that the embodiments described above in reference to FIGS. 3 through 5 illustrate various exemplary placements of dopant in relation to the rod, housing, end fittings and seals of the insulator, and that other variations and combinations of these embodiments are possible.

Dopant Composition

Water Soluble Dopants

For the embodiments described above, the dopant is a chemical substance that is activated with water or is transported by water that penetrates the insulator housing and comes into contact with the dopant on or near the outer surface of the insulator rod. It is assumed that water has penetrated the insulator housing or rubber seal through cracks, gaps, or other voids in the housing or seal, or in any of the interfaces between the end fittings, seal, and housing. In one configuration, the dopant comprises a substance that is able to leach through the permeation pathway and migrate along the outside surface of the insulator housing. Embodiments of the present invention take advantage of the fact that if water migrates to the inside of the insulator, then compounds of similar size and polarity should be able to migrate out as well. The dopant is composed of elements that are not readily found in the environment so that a concentration gradient will favor outward movement of the dopant through the two-way diffusion or permeation path and to minimize false positives from environmental contamination.

In one embodiment of the present invention, the dopant, e.g., dopant 308, is a water-soluble laser dye. One example of such a dopant is Rhodamine 590 Chloride (also called Rhodamine 6G). This compound has an absorption maximum at 479 nm and for a laser dye is used in a 5×10E-5 molar concentration. This dye is also available as a perchlorate and a tetrafluoroborate. Another suitable compound is Disodium Fluorescein (also called Uranine). This compound, used as a laser dye at 4×10E-3 molar concentration, has an absorption max at 412 nm and a fluorescence range of 536–568 nm. A groundwater tracing dye could be also used for the dopant. Groundwater tracing dyes have fluorescent characteristics similar to laser dyes, but can also be visible to the naked eye.

In an alternative embodiment of the present invention, the dopant can be an infrared absorbing dye. An example of such dyes include Cyanine dyes, such as Heptamethinecyanine, Phthalocyanine and Naphthalocyanine Dyes. Other examples include Quinone and Metal Complex dyes, among others. Some of these exemplary dyes are sometimes referred to as "water-insoluble" dyes since their solubilities can be less than one part per two thousand parts water. In general, water solutions on the order of parts per million are sufficient to provide a detectable change. Dyes with greater water solubilities can also be employed.

In general, the characteristics of the dopant used for the present invention include the lack of migration of the dopant from within a non-penetrated or undamaged insulator, as well as a dopant that remains stable and chemically inert within the insulator for a long period of time (e.g., tens of years) and under numerous environmental stresses, such as temperature cycles, corona discharges, wind loads, and so on. Other characteristics desirable for the dopant are strong detector response, migration/diffusion characteristics correlating with water, stability in the environment once activated for a long period of time (e.g., at least one year) to allow detection long after moisture ingress in the insulator.

In one embodiment, the dopant can be enhanced by the addition of a permanent stain. This would provide a lasting impression of the presence of the dopant on the surface of the insulator, even if the dopant itself does not persist outside of the insulator. The dye may be provided in a microencapsulated form that effectively dissolves when in contact with moisture. Such microencapsulation helps to increase the longevity of the dye and minimize any possible effect on the performance of the insulator. Also suitable for use as dopants are some materials that are not technically known as dyes. For example, polystyrene can be used as a dopant. Polystyrene has a peak absorption excitation at about 260 nm and its peak fluorescence at approximately 330 nm. For this embodiment, polystyrene can be encapsulated in nanospheres that are coated to adhere to the insulator outside surface. Upon migration to the insulator exterior, mercury light could be used as an excitation source to excite the polystyrene spheres and enable detection through a suitable detector, such as a daytime corona (e.g., DayCor™) camera that can detect the radiation in the 240–280 nm range, which is within the UV solar blind band (corona discharges typically emit UV radiation from 230 nm to 405 nm).

The polystyrene spheres could be coated with or made of a material with a surface energy lower than that of weathered rubber, but higher than virgin rubber. In this manner, the spheres would not wet the rubber on the inside surface of the insulator, but would wet and adhere to the weathered exterior surface. Physical entrapment from the roughened weathered rubber surface would help to keep the nanospheres from washing off of the housing. Alternatively, a "solar glue" that is inactive within the insulator, but becomes active upon exposure to sunlight could be used to help adhere the nanospheres to the insulator surface.

The dopant could also be comprised of water insoluble dyes for which the strongest signal is for a non-aqueous solution. An example of such a compound is polyalphaolefin (PAO) which is typically used as a non-conducting fluid for electronics cooling. PAO is a liquid, and can be used as a solvent for lipophilic dye. For this embodiment, a dye could be dissolved in PAO and added as a liquid layer between the rod and housing. Upon exposure to moisture through a permeation pathway, the PAO-dye solution would preferentially wet the exposed rubber in the housing and then migrate to the exterior of the housing by capillary action. As a related alternative, an organic solvent or PAO can be microencapsulated into a water soluble coating. The water-soluble microcapsules could be dry blended with a water insoluble dye, and the mixed powder could then be placed within the insulator. Upon contact with penetrating moisture, the water-soluble capsules will dissolve and cause the released organic solvent to dissolve the dye. The organic solvent-dye solution would then wet the rubber and migrate out of the insulator housing.

Figure 6A:
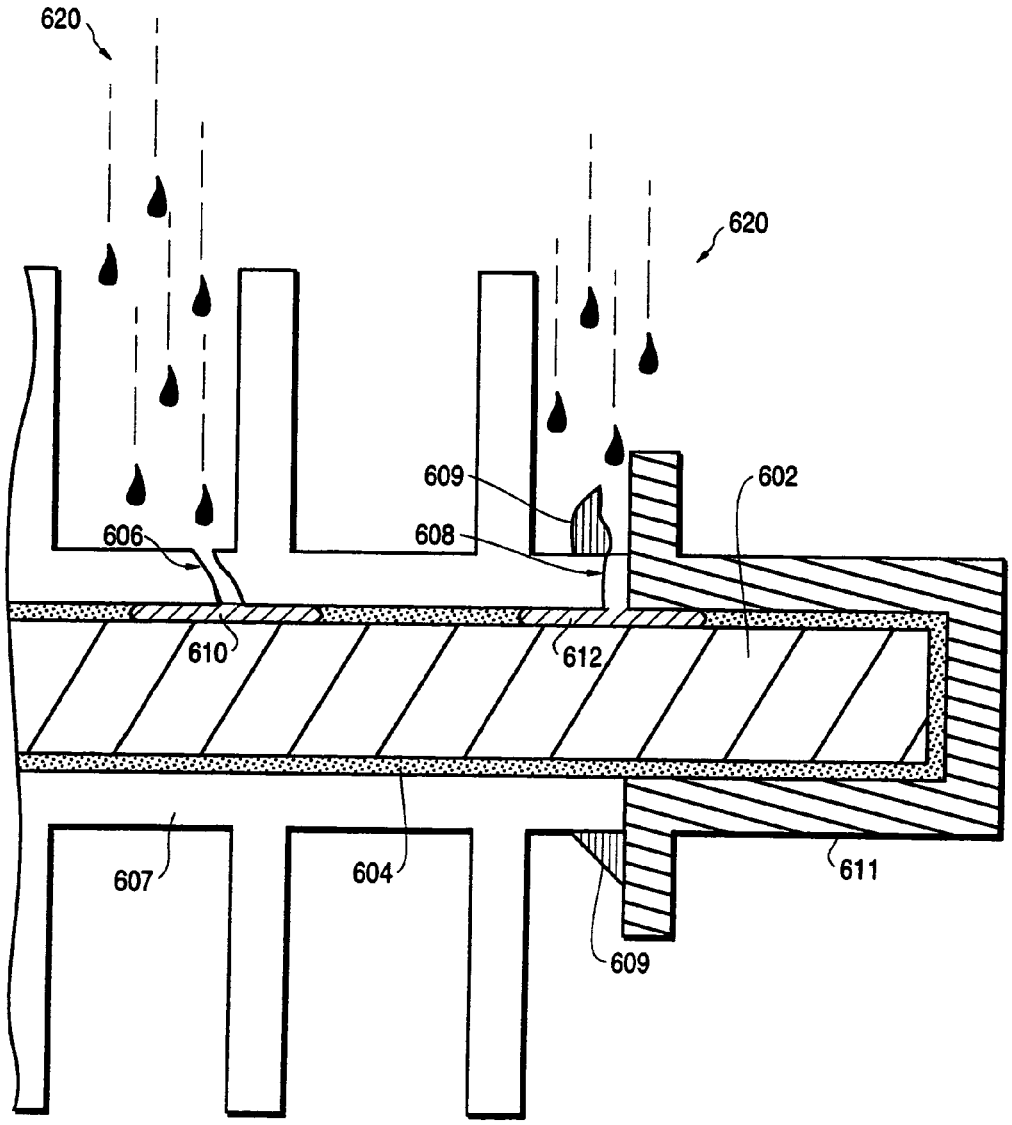
FIG. 6A illustrates the activation of dopant in the presence of moisture that has penetrated to the rod of a composite insulator, according to one embodiment of the present invention.
Figure 6B:
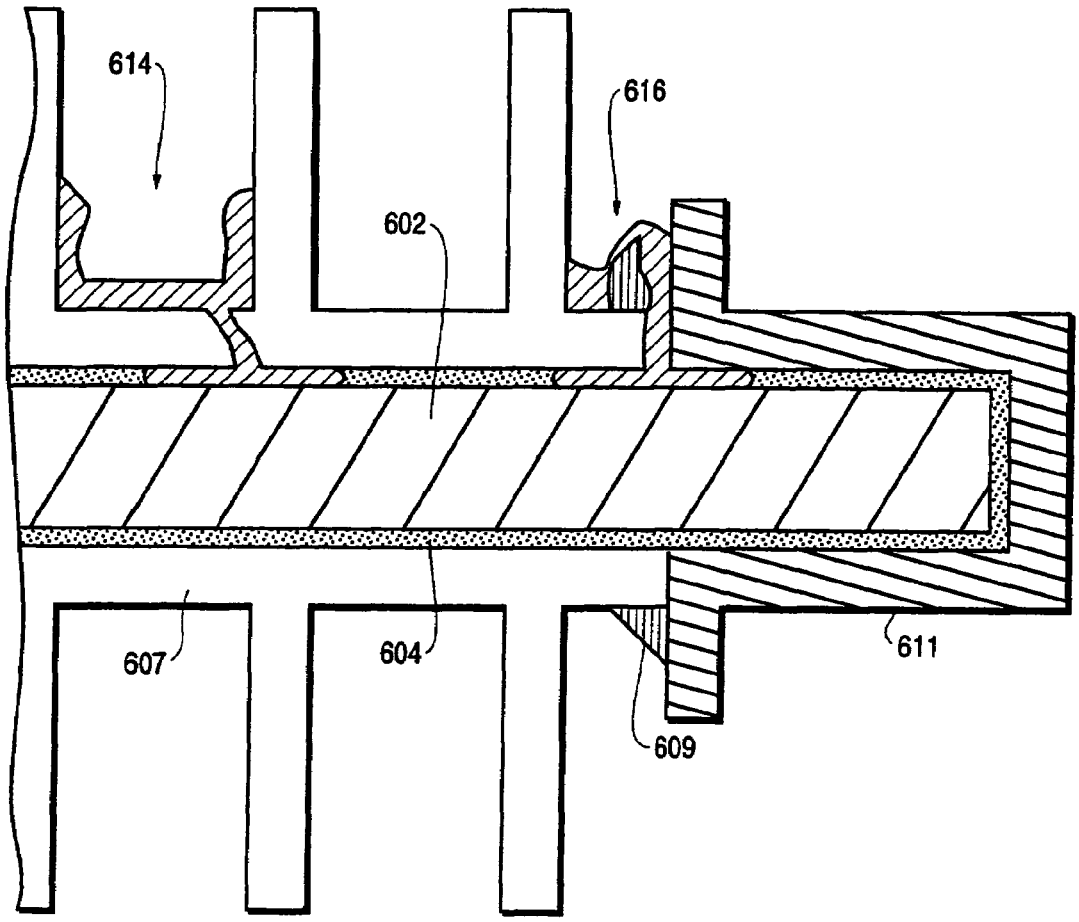
FIG. 6B illustrates the migration of the activated dopant of FIG. 6A.

FIGS. 6A and 6B illustrate the activation and migration of dopant in the presence of moisture that has penetrated to the rod of a composite insulator, according to one embodiment of the present invention. In FIG. 6A, moisture from rain 620 has penetrated a crack 606 in the housing 607 of a composite insulator. The crack 606 represents a permeation pathway that allows moisture to penetrate past the insulator housing and to the rod. Another permeation pathway 608 may be caused by a failure of seal 609. A dopant 604 is disposed between the inner surface of the housing 607 and the outer surface of the rod 602, such as is illustrated in FIG. 3. Upon contact with the moisture, a portion 610 or 612 of the dopant 604 becomes activated. The difference in concentration between the dopant in the insulator and in the environment outside of the insulator causes the activated dopant to migrate out of the permeation pathway 606 or 608. The migration of the activated dopant out from within the insulator to the surface of the insulator housing is illustrated in FIG. 6B. As shown in FIG. 6B, upon activation, the activated dopant leaches out of the permeation pathway and flows to form a deposit 614 or 616 on the surface of the housing. If a penetrating dye or stain is used, the leached dye 614 can be intermingled in the housing through penetration of the polymer network of the housing, rather than a strict surface deposit, as shown in FIG. 6B. Depending on the dye or stain used for the dopant, its presence can be perceived through the use of the appropriate imaging or viewing apparatus.

Figure 7:
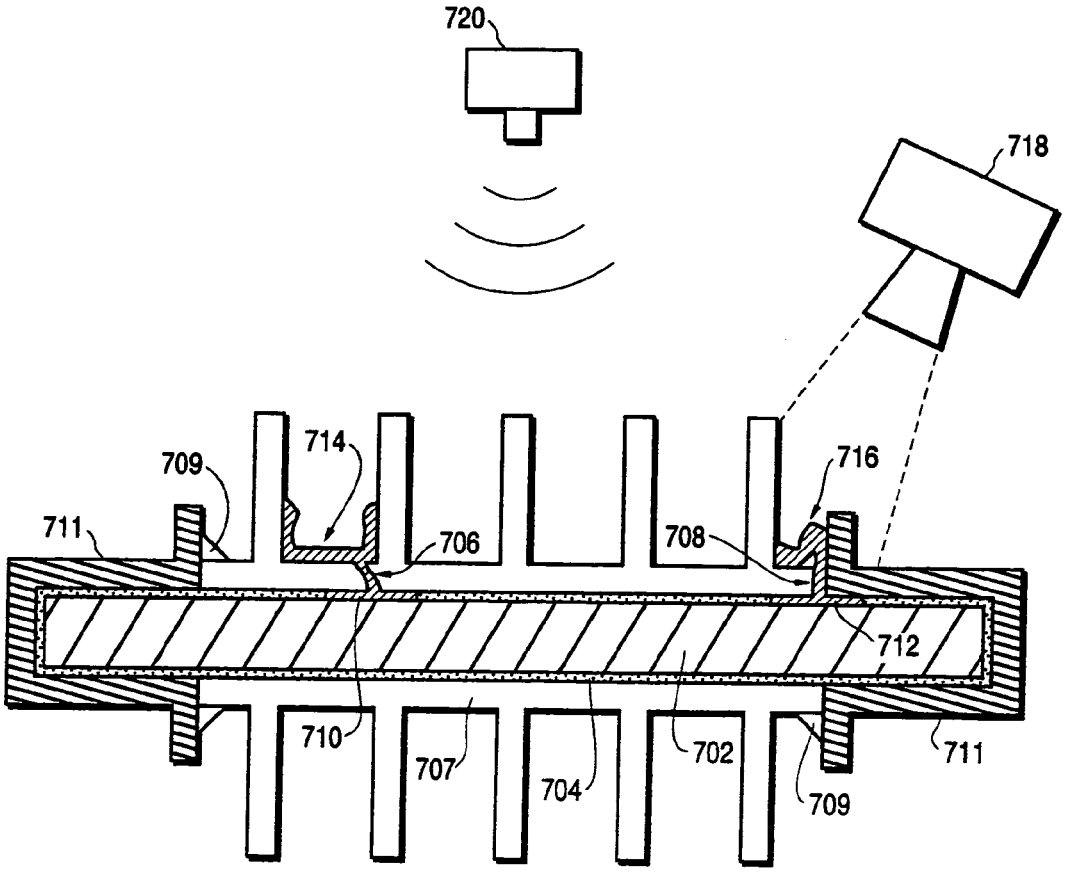
FIG. 7 illustrates a composite insulator with activated dopant and means for detecting the activated dopant to verify penetration of moisture to the insulator rod, according to one embodiment of the present invention.

FIG. 7 illustrates the activation, migration, and detection of dopant in the presence of moisture that has penetrated to the rod of a composite insulator, according to one embodiment of the present invention. As illustrated in FIG. 6B, when the insulator housing is cracked or if the seal is not effective, the rod would be exposed and the dopant migrates out to the external surface of the insulator. FIG. 7 illustrates two exemplary instances of penetration of water into the insulator housing. Crack 706 is a void in the housing of the insulator itself, such as that illustrated in FIGS. 6A and 6B. The resultant water ingress creates activation 710 of the dopant 704. The activated dopant then flows back out through the crack 706 to form a dopant deposit 714 on the surface of the insulator housing. Another type of permeation pathway may be created by a gap between the seal 709 and the housing 707 and/or end fitting 711. This is illustrated as gap 708 in FIG. 7. When moisture penetrates through this gap, the dopant 704 is activated. The activated dopant 712 then flows out of the gap 708 to form deposit 716. Depending on the constitution of the dopant, its presence on the surface of the insulator can be detected using the appropriate detection means. For example, source 720 illustrates a laser or ultra-violet transmitter that can reveal the presence of dopant deposits 714 or 716 that contain dyes that are sensitive to transmissions at the appropriate wavelength, such as, laser-induced fluorescent dyes. Similarly, source 718 may be a visual, infrared or hyperspectral camera. Notch filters may be used to detect the presence of any dopant deposits through reflection, absorption, or fluorescence at particular wavelengths. These inspection devices allow an operator to perform an inspection of the insulator from a distance (the naked eye may also identify a defective unit if the dye reflects light in the visible wavelength range). They also lend themselves to automated inspection procedures. The detection of dopant on the external surface of the insulator provides firm evidence that the insulator rod has been exposed to moisture due to either a faulty seal or crack in the insulator housing, or any other possible void in the insulator or end fittings. Although an actual failure, such as brittle fracture of the rod may not yet be present, the exposure of the rod to moisture indicates that such a failure mode may eventually occur. In this situation, the insulator can be serviced or replaced as required. In this manner, the doped composite insulator provides a self-diagnostic mechanism and provides a high risk warning early on in the failure process. Depending on the type of dye and source used, the detector can either be a separate unit (not shown), a unit integrated with the source 718 or 720, or a human operator, in the case of visually detectable dyes.

Depending on the dopant composition and the detection means, only a very small amount of dye may need to be present to generate a detectable signal. For example one part per million (1 ppm) of dye on the surface of the insulator may be sufficient for certain dopant/dye compositions to produce a signal using UV, IR, laser, or other similar detection means. The dopant distribution and packaging within the insulator also depends on the type of dopant utilized. For example, a one kilogram section of fiberglass rod may contain (or be coated with) about 10 grams of dye.

Oil Soluble Dopants

In one embodiment of the present invention, the dopants used for indicating the penetration of moisture through a housing, as shown in FIGS. 3, 4, and 5 are oil-based dye or stain compounds that are formulated to provide improved bonding to silicone rubber and greater resistance to fading in external conditions.

The use of oil-soluble dye compounds as a dopant within the NCI housing requires certain transport mechanisms to facilitate migration of the dopant through the permeation pathways in the housing and along the surface of the housing in the area of the moisture penetration. Such transport mechanisms can include micelles that encapsulate the oil-soluble dye and allow migration along the mechanical fracture of the NCI polymer housing, or a common solvation system that permits diffusion of the dye through the NCI polymer housing.

Figure 8A:
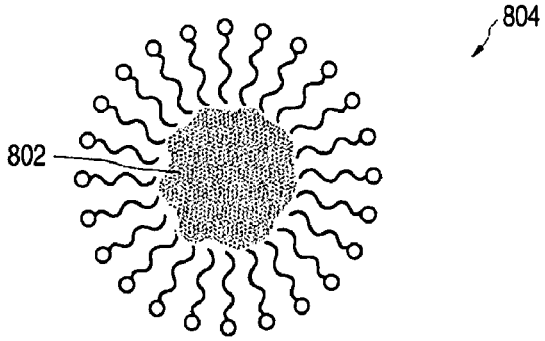
FIG. 8A illustrates a micelle structure that can be used to encapsulate an oil-based dopant according to one or more embodiments of the present invention.

In one embodiment, the dopants that are distributed in or on the surface of the NCI core or housing, as illustrated in FIG. 3, 4, or 5 comprise an oil-soluble dye that are aggregated into micellar structures. In general, a micelle is a particular grouping of surfactant molecules where either the hydrophobic (in polar continuous phase) or the hydrophilic (in a nonpolar continuous phase) ends cluster inward to escape the continuous phase. When surfactants are present above the critical micelle concentration, they act as emulsifiers. For the micellar system, once the dopant is activated in the presence of water, the solvent and dye are contained in the micelle core. This is illustrated in FIG. 8A, in which a solvent and dye 802 is contained within a micelle structure 804.

Figure 8B:
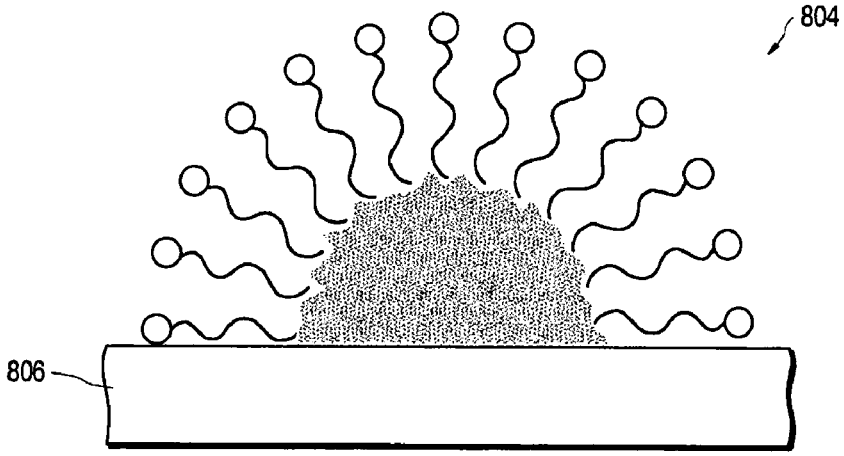
FIG. 8B illustrates the migration of a micelle structure to the surface of an insulator housing, according to one embodiment of the present invention.
Figure 8C:
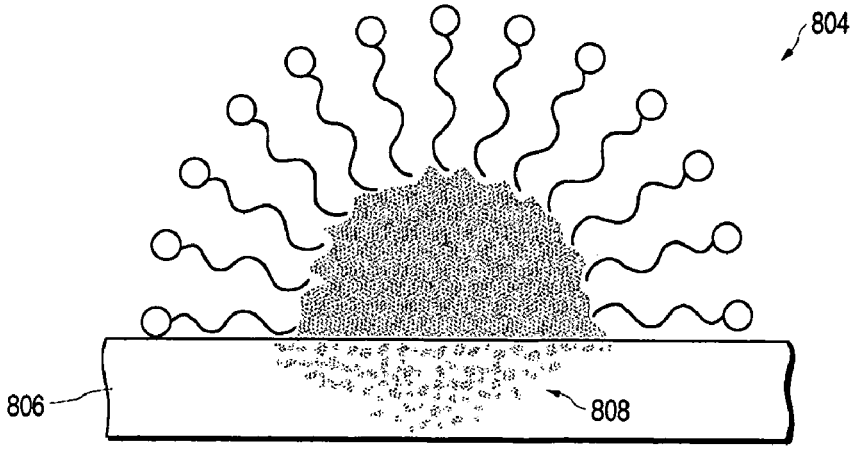
FIG. 8C illustrates the release of a dye from a micelle and diffusion through a polymer surface, according to one embodiment of the present invention.
Figure 9A:
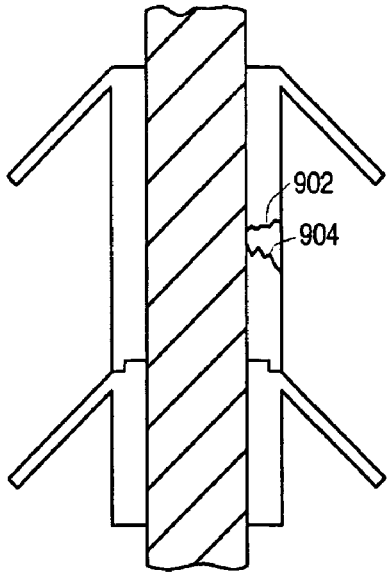
FIG. 9A illustrates the release of an oil-soluble dye through the housing of a non-ceramic insulator according to one embodiment of the present invention.
Figure 9B:
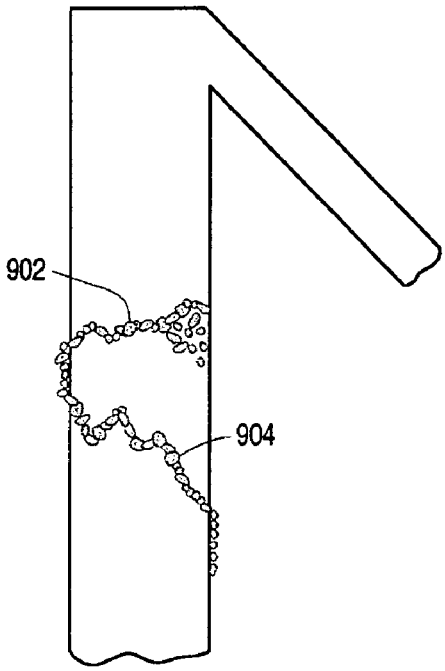
FIG. 9B illustrates a more detailed view of the release of an oil soluble dye, in FIG. 9A.

FIG. 8B illustrates the diffusion of a micellar structure 804 through a surface 806, such as the polymer housing of a non-ceramic insulator. The micelles migrate along the water permeation pathways (entry/egress routes) to the surface of the housing. Once on the surface, the oil and dye within the micelle structure diffuses into the polymer material of the housing, as shown by the stain region 808 in FIG. 8C. This stains the polymer housing. For the embodiment of the oil-soluble dopant in which micelle structures are used, there are two potential routes to the external surface of the housing. The first is the diffusion of the solvent and dye through the polymer, and the second is the migration of the micelles along the water pathway to the external surface. This is illustrated in FIG. 9A as pathways 902 and 904 respectively.

In an alternative embodiment of the oil-soluble dopant system, the dopant could include dyes that stain lipophilic regions of cells. These can include stains like Oil Red O, Oil Blue N, and Sudan IV. Marker technology used to color fuels, oils, and greases can also be used as the oil soluble dye. For example, Unisol® dye concentrates or similar dyes dissolved in petroleum distillates are used as dispersants in silicone oil and are suitable for use as an oil-soluble dye compound for embodiments of the present invention. Likewise, paints used for silicone rubber that comprise pigments dispersed in solvent to form a paste can also be used. In one embodiment, emulsifiers can be used to form a silicone vesicle delivery system for lipophilic and water-soluble dyes. The dye could also be encased within water-activated microcapsules in silicone grease, or water-activated microcapsules containing silicone oil or oligomers.

Depending upon how the dye is encapsulated, diffusion of the dye through the housing due to the permeation and presence of water in the core of the NCI could be accomplished by several different methods. These include capillary action, osmotic pressure gradients, diffusion of the dopant through the polymer housing, and micellar migration. In one embodiment, certain compounds, such as methylene blue, or similar water-soluble compounds could be used in conjunction with the oil-soluble compounds to build pressure in the presence of water to help drive the dye to and along the surface of the housing.

In a further alternative embodiment, the oil-based dopant could comprise nanotechnology enabled materials; such as semiconducting quantum dots, gold or silver nanoparticles, and so on. Such compounds are exceedingly small, typically only a few thousand atoms, or less. This gives them extraordinary optical properties, which can be customized by changing the size and/or composition of the dots. These properties are brought about by the "quantum confinement" of the electrons within the molecules of the dots. In one embodiment, the organic dye molecules are substituted with quantum dot particles. The typical core diameter of a quantum dot is 5 nm. Quantum dots can be "capped" or encapsulated with other components that can be used to adjust their chemical attraction to or repulsion from other materials. Because of their small size, they can migrate to the external surface of the polymer housing of non-ceramic insulators. In general, quantum dot indicators are much more physically robust than organic dyes, and also fluoresce with much higher quantum yield than standard fluorescent dyes. Although quantum dot compounds are typically made of semiconductor materials (such as cadmium, selenide, and so on), their small size and low concentration has minimal electrical effect in power insulator applications. The quantum dot compounds could be included in the micelle structures, such as shown in FIG. 8A.

As described above with reference to the water-soluble dye embodiments, detection of dopants using oil-soluble dyes could utilize visual techniques for stains, dyes, inks, or pigments that provide a visible color or shade marker, or infrared techniques for markers that are detectable in the infrared range.

Although some of the embodiments described above are directed to oil-soluble dopants, such as petroleum-derived substances, it should be noted that other types of non-water soluble or non-water based dopants can also be used. These can include dopants made of substances derived from mineral, vegetable, animal, or synthetic sources, and that are generally viscous and soluble in various organic solvents, but not in water.

Previously discussed embodiments described a dopant that contains a dye that migrates out of the housing upon activation by penetrating moisture. Alternatively, the dopant could comprise an activating agent that works in conjunction with a substance present on the surface of the housing. Upon migration of the dopant to the surface, a chemical reaction occurs to "develop" a dye that can be seen or otherwise detected on the surface of the housing. In a related embodiment, the housing can include a wicking agent that helps spread the dopant or dye along the exterior surface of the housing and thereby increase the stained area. The wicking agent should be hydrophobic to maintain the functionality of the waterproof housing, thus for this embodiment, a lipophilic dye should be used.

As a further alternative embodiment, the outside surface of the housing itself could be treated, such as by ozone or plasma treatment to facilitate the staining of the housing by the dye that migrates out and along the surface.

In one embodiment of the present invention, an automated inspection system is provided. For this embodiment, the non-ceramic insulator is scanned periodically using appropriate imaging apparatus, such as a digital still camera or video camera. The images are collected and then analyzed in real-time to detect the presence of leached dye on the surface of the insulator. A database stores a number of images corresponding to insulators with varying amounts of dopant. The captured image is compared to the stored images with reference to contrast, color, or other indicia. If the captured image matches that of an image with no dopant present, the test returns a "good" reading. If the captured image matches that of an image with some dopant present, the test returns a "bad" reading, and either sets a flag or sends a message to an operator, or further processes the image to determine the level of dopant present or the indication of a false positive. Further processing could include filtering the captured image to determine if any surface contrast is due to environmental, lighting, shadows, differences in material, or other reasons unrelated to the actual presence of leached dopant.

Aspects of the present invention can also be applied to any other composite system or polymer article with external protective coverings in which failure of the system can be induced by water penetration through the housing. Composite pressure vessels are illustrative of such a class of items. For example, compressed natural gas (CNG) tanks for use in vehicles or for storage are often made of fiberglass and can fail due to stress corrosion cracking or related defects, as described above. Such tanks are typically covered by a waterproof liner or impermeable sealer to prevent moisture penetration. The composite overwraps used in these tanks or vessels often do not have a sufficiently good external barrier to moisture ingress, and are vulnerable to water penetration. The fiberglass material comprising the tank can be embedded or chemically doped with a dye as shown in FIG. 3, 4 or 5, and in accordance with the discussion above relating to non-ceramic insulators. Exposure of the tank material to moisture penetrating through the waterproof liner or seal will cause migration of the dye to the surface of the tank where it can be perceived through visual or automated means.

In certain applications, exposure to acid rather than water moisture can lead to potential failures. Depending upon the actual implementation, the dopant could be configured to react only to acid release (e.g., pH of 5 and below), rather than to water exposure. Microencapsulation techniques or the use of pharmaceutical reverse enteric coatings, such as those that do not dissolve at a pH of greater than 6 or so, can be used to activate the dopant in the presence of an acid. Alternatively, a pH sensitive dye that is clear at neutral pH but develops color at an acidic level, can be used.

In the foregoing, indicators for providing early warning of failure conditions for a composite insulator or similar article, due to exposure of the insulator core to the environment have been described. Although the present invention has been described with reference to specific exemplary embodiments, it will be evident that various modifications and changes may be made to these embodiments without departing from the broader spirit and scope of the invention as set forth in the claims. Accordingly, the specification and drawings are to be regarded in an illustrative rather than a restrictive sense.

What is claimed is:

1. A composite insulator for supporting power transmission cables, the composite insulator comprising:

a rod having an outer surface and a first end and a second end;

a housing having an inner surface and an outer surface and surrounding the rod, wherein the inner surface of the housing is adjacent to at least a portion of the outer surface of the rod;

an oil-soluble dopant disposed proximate the outer surface of the rod and the inner surface of the housing, the dopant containing a dye and formulated to diffuse in the presence of water, and configured to migrate to an outer surface of the housing through a permeation pathway in the housing upon exposure of the dopant to moisture, disperse along a visible portion of the outer surface, and leave a semi-permanent and perceivable stain on the visible portion of the outer surface to indicate the presence of water ingress in the housing.

2. The composite insulator of claim 1 wherein rod comprises a fiberglass rod and the housing is made of silicone-based rubber.

3. The composite insulator of claim 2 wherein the dye is encapsulated within a micelle structure, and wherein migration of the dopant to the outer surface of the housing occurs through micellar migration.

4. The composite insulator of claim 2 wherein the dye comprises a siloxane-modified dye for staining silicone rubber.

5. The composite insulator of claim 2 wherein the dye includes silicone oil, toluene, or a non-aqueous solvent as a carrier fluid for migrating the dopant to the outer surface of the housing.

6. The composite insulator of claim 2 wherein the dye comprises a nanoparticle enabled material for staining the outer surface of the housing.

7. The composite insulator of claim 1 wherein the oil soluble dopant is disposed along the outer surface of the rod.

8. The composite insulator claim 1 further comprising:

a first rubber seal placed between the first end of the housing and a first end fitting; and a second rubber seal placed between the second end of the housing and a second end fitting.

9. The composite insulator of claim 8 wherein the dopant is disposed between the outer surface of the rod and the first end fitting and second end fitting.

10. The composite insulator of claim 1 wherein the dopant is disposed throughout the glass fiber matrix comprising the rod.

11. The composite insulator of claim 1 wherein the dopant is detectable by a process chosen from the group consisting of: ultraviolet detection means, infrared detection means, visual inspection means, laser radiation induced fluorescence means, laser radiation induced absorption means, or hyperspectral imaging detection means.

12. An insulator for insulating a power transmission line from a support tower, the insulator comprising:

a fiberglass rod having a first end and a second end;

a rubber-based housing wrapped around an outer surface of the rod;

a chemical dopant containing an oil soluble dye disposed between the housing and the rod, the dopant configured to leach out of a permeation pathway that allows moisture to penetrate the housing and contact the rod, and travel along a portion of an outer surface of the housing in a migration pattern driven by a concentration gradient produced by presence of moisture in the permeation pathway.

13. The insulator of claim 12 wherein the oil soluble dye is encapsulated within a micelle structure, and wherein the migration pattern is further driven by micellar migration.

14. The insulator of claim 12 wherein the oil soluble dye comprises a siloxane-modified dye for staining the rubber-based housing, and wherein the migration pattern is further driven by diffusion of the dopant through the housing.

15. The insulator of claim 12 wherein the oil soluble dye comprises a nanoparticle enabled material.

16. The insulator of claim 12 wherein the oil-soluble dye is sensitive to radiation at a predetermined wavelength when the dopant becomes activated and leaches out of the permeation pathway.

17. A method of providing early detection of a potential failure of an insulator due to exposure of a rod within the insulator to moisture, the method comprising the steps of:

affixing a silicone housing around the rod;

inserting a dopant containing an oil soluble dye proximate an outer surface of the rod and an inner surface of the housing, the dopant configured to leach out of a permeation pathway that allows moisture to penetrate the housing and contact the rod, disperse along a visible portion of the outer surface, and leave a semi-permanent perceivable stain on the visible portion of the outer surface to indicate the presence of the permeation pathway in the housing, the dye within the dopant being perceivable on the outer surface at a predefined distance from the insulator.

18. The method of claim 17 wherein the dye comprises one of a micellar structure encapsulated dye, a siloxane modified dye, an acid-responding dye system, or an indicator formulated with a nanoparticle enabled material.

19. The method of claim 18 wherein the dopant is configured to migrate to the outer surface of the housing in the presence of water on the surface of the rod, the migration of the dopant driven by a means selected from the group consisting essentially of capillary forces, osmotic pressure gradients, concentration gradients, diffusion of the dye, and micellar migration.

20. The method of claim 19 wherein the dye is configured to reflect radiation transmitted at a predetermined wavelength.

21. The method of claim 20 wherein the dopant is detectable by a process chosen from the group consisting of: ultraviolet detection means, infrared detection means, visual inspection means, laser radiation induced fluorescence means, laser radiation induced absorption means, or hyperspectral imaging detection means.

* * * * *

UNITED STATES PATENT AND TRADEMARK OFFICE

CERTIFICATE OF CORRECTION

PATENT NO. : 7,002,079 B2
DATED : February 21, 2006
INVENTOR(S) : Joseph N. Mitchell et al.

It is certified that error appears in the above-identified patent and that said Letters Patent is hereby corrected as shown below:

Title page,
Item [75], Inventors, delete "Andrew J. Philips" and replace with -- Andrew J. Phillips --.

Signed and Sealed this

Sixteenth Day of May, 2006

JON W. DUDAS
*Director of the United States Patent and Trademark Office*